US005535998A

United States Patent [19]

Geffert et al.

[11] Patent Number: 5,535,998

[45] Date of Patent: Jul. 16, 1996

[54] SHEET SEPARATION METHOD AND APPARATUS

[75] Inventors: Manfred Geffert, Minden; Joachim Schroder, Mellinghausen, both of Germany

[73] Assignee: Kolbus GmbH & Co. KG, Rahden, Germany

[21] Appl. No.: 521,621

[22] Filed: Aug. 31, 1995

Related U.S. Application Data

[63] Continuation of Ser. No. 226,814, Apr. 12, 1994, abandoned.

[30] Foreign Application Priority Data

Apr. 16, 1993 [DE] Germany ..... 43 12 476.3

[51] Int. Cl.[6] ..... B65H 3/08

[52] U.S. Cl. ..... 271/99; 271/101

[58] Field of Search ..... 271/20, 99, 100, 271/101, 104, 105, 106, 107

[56] References Cited

U.S. PATENT DOCUMENTS

| | | | |
|---|---|---|---|
| Re. 28,048 | 6/1974 | Hageman et al. | 271/101 |
| 3,394,930 | 7/1968 | Guggisberg | 271/101 X |
| 3,586,316 | 6/1971 | Ehlsheid et al. | 271/101 X |
| 4,013,283 | 3/1977 | Tress et al. | 271/106 X |

FOREIGN PATENT DOCUMENTS

| | | | |
|---|---|---|---|
| 115189 | 9/1969 | Denmark | 271/101 |
| 66 05 989 | 11/1970 | Germany . | |
| 33 47 148 | 9/1984 | Germany . | |
| 287699 | 3/1991 | Germany | 271/100 |
| 316227 | 11/1971 | U.S.S.R. . | |

*Primary Examiner*—William E. Terrell
*Assistant Examiner*—T. Kelly
*Attorney, Agent, or Firm*—Chilton, Alix & Van Kirk

[57] ABSTRACT

The front limit stop of the stack receiving magazine of a sheet separator is provided, in the region contacted by the lowermost sheets of the stack, with a retractable wall portion. The movements of this retractable wall portion are synchronized with the operation of a device which causes downward deflection of the edge region of a sheet located adjacent the magazine front limit stop. Accordingly, simultaneously with the application of the deflecting force, the frictional retaining force is removed from the edge region of the sheet to be separated.

16 Claims, 1 Drawing Sheet

3
7a
7
1
1a
3a
2
4
5
6

3
7
1
1a
4
3a
2
7a
8
5
6

SHEET SEPARATION METHOD AND APPARATUS

This is a continuation of application Ser. No. 08/226,814 filed on Apr. 12, 1994 now abandoned.

BACKGROUND OF THE INVENTION

1. Field of the Invention

The present invention relates to the formation of book blocks and particularly to the sequential separation of folded printed sheets from stacks of such sheets in magazines. More specifically, this invention is directed to a sheet separator for withdrawing individual sheets from a stack of sheets and especially to apparatus for withdrawing signatures from magazines pursuant to the manufacturer of books. Accordingly, the general objects of the present invention are to provide novel and improved methods and apparatus of such character.

2. Description of the Prior Art

While not limited thereto in its utility, the present invention has been designed for, and is particularly well suited for use in, the formation of book blocks in the course of manufacturing books. In the manufacture of a book it is common to assemble the book block on a collecting conveyor by sequentially withdrawing printed sheets from magazines. Such printed sheets may be in the form of "signatures", i.e., the sheets may each have a "spine" fold and define four pages of the text. In the course of book block formation, a plurality of serially arranged separating devices are employed for gathering the printed sheets. Each of the separating devices will typically have a pull-off drum which is located between a magazine and a supporting table which is associated with the collecting conveyor. The pull-off drum supports a gripping mechanism which engages an edge of the lowermost sheet in the magazine subsequent to that edge having been displaced away from the stack. The displacement is typically a downward deflection which is accomplished through the use of a suction device. When the sheets to be withdrawn from the magazine are in the form of the signatures, the downwardly deflected edge will be the spine fold portion of the sheet.

In the prior art, the sheet separating device has included a front limit stop which in part defines the stack-receiving magazine. This front stop will customarily be provided with "separating points" which support the stack of sheets in the magazine at one side of a discharge opening in the bottom of the magazine. The magazine will also include, in addition to the front limit stop, a pair of lateral guides. In operation, a suction device will be caused to move upwardly through the discharge opening to "engage" the lowermost sheet in the stack in the magazine. After the lowermost sheet is engaged, the suction device will move downwardly and thereby deflect the edge region of the lowermost sheet through the discharge opening to a point where it is engaged by the gripper mechanism on the pull-off drum.

The prior art separating methods and apparatus, as briefly described above, have not had the requisite reliability. This lack of reliable operation, to a large degree, results from the fact that the spine folds of the stacked sheets in a magazine bear relatively forcibly against the front limit stop of the magazine. This relatively forcible contact results from the fact that, while the lowermost sheet is being pulled from the bottom of the stack, the frictional forces between the sheets comprising the stack result in their being pulled in the direction of the front limit stop. As a consequence, feed failures are common since the suction device is frequently unable to overcome the frictional force between the leading edge of the lowermost sheet and the magazine front limit stop. The chance of a misfeed, is particularly pronounced when the sheets to be separated from the magazine are comprised of relatively stiff material.

SUMMARY OF THE INVENTION

The present invention overcomes the above briefly discussed and other deficiencies and disadvantages of the prior art by providing a novel and improved method for the separation of sheets, and particularly printed sheets having a spine fold, from a stack of sheets disposed in a magazine. The present invention also encompasses a sheet separator for implementing this novel method.

In accordance with the present invention, the front limit stop of the stack receiving magazine of a sheet separator is provided, in the region contacted by the lowermost sheet of the stack, with a retractable wall portion. The retraction and return to its normal position of this wall portion is synchronized with the operation of a suction device which exerts a downward deflecting force on the lowermost sheet of a stack in the magazine. Thus, simultaneously with the application of the downward deflecting force, the frictional retaining force is removed from the edge region of the sheet to be separated.

Apparatus in accordance with a preferred embodiment of the invention includes a pivotally mounted stop member which is caused to move into and out of alignment with the front limit stop of the magazine in synchronism with the operation of the sheet deflector. This pivotal stop component also functions as a stack lifter which engages the underside of the stack immediately subsequent to downward deflection of the leading edge region of the lowermost sheet in the stack.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENT

Figure 1:
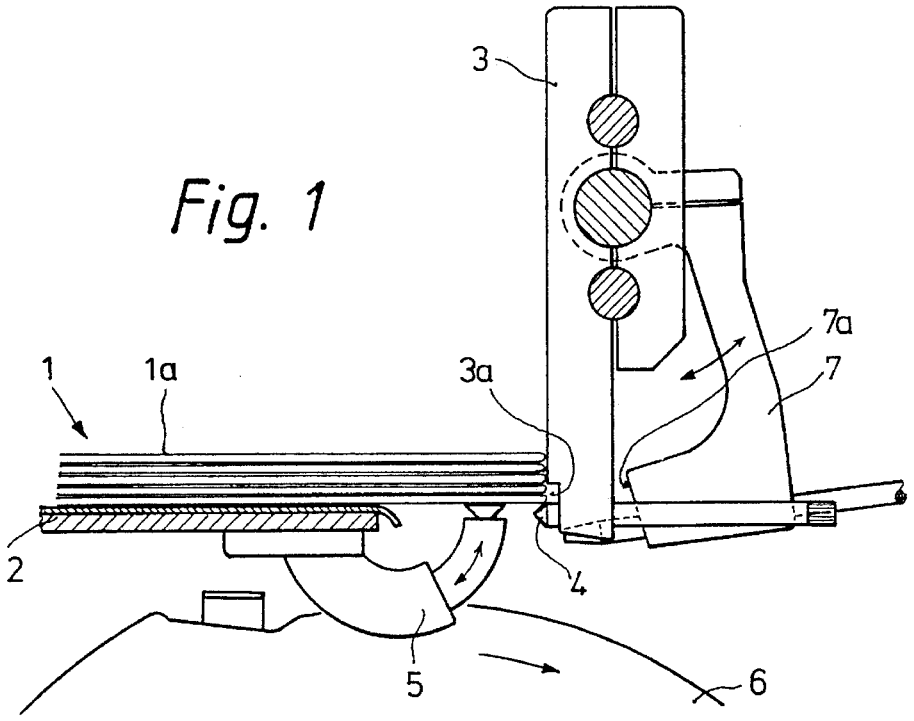
FIG. 1 is a schematic, side-elevation view of apparatus for sequentially separating sheets from a stack receiving magazine, FIG. 1 depicting the apparatus just prior to downward deflection of the lowermost sheet of the stack.

With reference to the drawing, a stack of printed sheets, positioned in a magazine, is indicated generally at 1. Stack 1 is comprised of individual sheets 1*a* which are represented as signatures, i.e., sheets 1*a* each have a spine fold. The stack 1 is supported by the bottom plate 2 of a magazine and the spine folds 1*a* are all in contact with the front limit stop of the magazine, the front limit stop being in the form of vertically oriented locating rails 3. The magazine bottom 2 is provided with an aperture or discharge opening which extends rearwardly from the front of the magazine as defined by the locating rails 3. The stack 1 is supported at the edge thereof which abuts the magazine front by separating points 4 which extend from the locating rails 3. The lateral space between the locating rails 3, and thus the separating points 4, as well as the extension of the separating points 4 from the locating rails 3 may be adjusted in the interest of achieving reliable separation. Such adjustments will be made to suit the condition and quality of the paper used for producing the printed sheets 1*a*.

Figure 2:
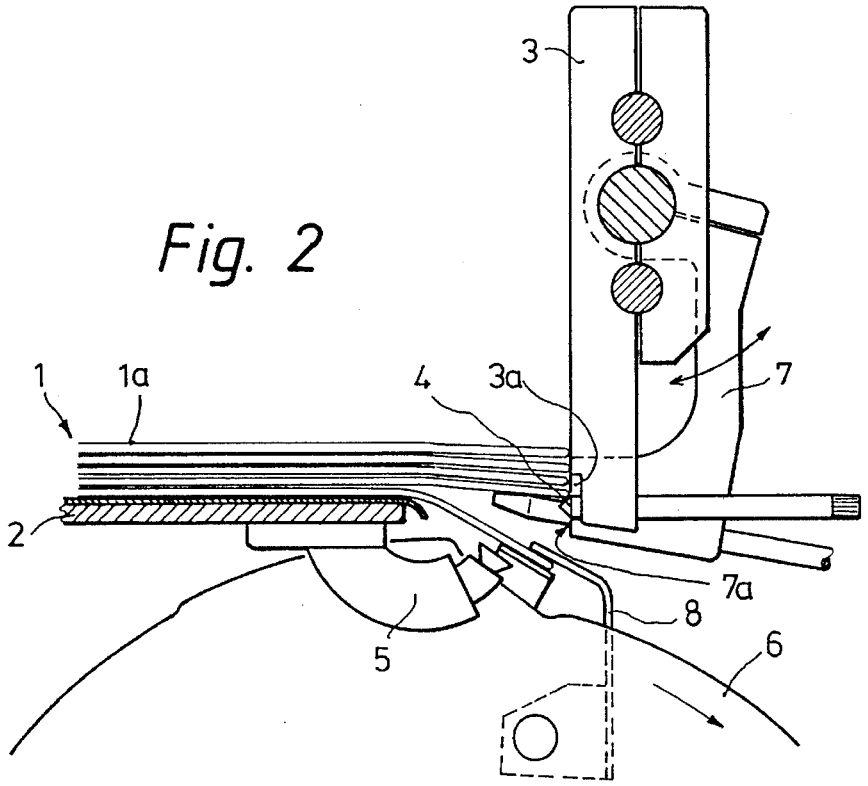
FIG. 2 is a view similar to FIG. 1 which depicts the apparatus subsequent to the downward inclination and gripping of the lowermost printed sheet of the stack.

In the region of the magazine discharge opening, an additional supporting means for the stack 1 is provided in the form of a stack lifter 7. Stack lifter 7 is pivotally mounted so that a stack engaging extension thereof may be moved between a position where it is located below the stack 1 of printed sheets, as shown in FIG. 2, and a retracted position as shown in FIG. 1. The extension and retraction of the stack lifter 7 is synchronized with the movement of a deflector 5. In the disclosed embodiment, and as is conventional in the printing industry, the deflector 5 comprises a suction device which may be moved between the positions of FIGS. 1 and 2 to "engage", and deflect downwardly, the region of the lowermost sheet 1*a* of stack 1 which bridges the magazine discharge opening.

During sheet separation, the suction device or devices 5 acquire the lowermost printed sheet 1*a* in a known manner, gripping the sheet in the vicinity of the spine fold, and deflect the edge region of the sheet downwardly away from the stack 1. This deflection delivers the sheet edge region to the operating zone of a gripping mechanism 8 carried by a pull-off drum 6. Rotation of drum 6 in the direction indicated by arrow will thus pull the gripped sheet from the bottom of the stack 1 in the magazine. The thus withdrawn sheet will be deposited on a stack of sheets similarly withdrawn from other magazines in sequence and deposited on a conveyor mechanism to form a book block.

In accordance with the present invention, a cut-out or set-back3*a* is provided at the lower ends of the locating rails 3 at the front of the magazine. The cut-outs 3*a* define a clearance space which abuts the sheet 1*a* which has been deflected downwardly. The function of maintaining vertical alignment of the sheets 1*a* of the stack 1 at the stack level occupied by the clearance space 3*a* is assumed by a stop face 7*a* on stack lifter 7. As noted above, the stack lifter 7 is operated in synchronism with the movements of the deflector 5. With the stack lifter 7 in the extended, i.e., the stack engaging condition as shown in FIG. 2, the stop face 7*a* of stack lifter 7 is located in the plane of the front face of the magazine as defined by the locating rails 3. In this position, the stop face 7*a* of the stack lifter prevents the lowermost sheet or sheets of the stack from entering the clearance space 3*a*. However, when the stack lifter 7 is pivoted to the retracted position of FIG. 1, any retaining force which would have been exerted by the front face of the magazine on the sheet 1*a* to be separated from the stack is removed. Accordingly, the lowermost printed printed sheet 1*a*, being free from any retarding action of the magazine front face, may be reliably deflected downwardly by the suction devices 5.

As will be appreciated by those skilled in the art, rather than in providing the stop face 7*a* on the stack lifter 7, a separate aligning element may be employed. Such a separate aligning element may be reciprocally mounted so as to have a front face which may be moved into and out of alignment with the front plane of the magazine in synchronism with the movements of the suction device 5. As yet another alternative, a separate aligning element which is pivotally mounted to the locating rails 3, i.e., an element separate from but movable with the stack lifter 7, may be employed.

While a preferred embodiment has been shown and described, various modifications and substitutions may be made thereto without departing from the spirit and scope of the invention. Accordingly, it is to be understood that the present invention has been described by way of illustration and not limitation.

We claim:

1. In an apparatus for serially separating individual sheets from a substantially aligned stack of substantially planar sheets disposed in a magazine, each sheet having a front edge, the apparatus having means which, in each separation operation, applies a deflection force to a sheet to be separated in the vicinity of its front edge, the deflection force being of sufficient magnitude to deflect the front edge of said sheet away from the stack, the apparatus further having a gripper mechanism for acquiring said deflected sheet and thereafter pulling said deflected sheet away from the stack, the apparatus also having a front stop which in part forms the stack receiving magazine, the front stop defining a planar abutment for the front edges of the sheets in the stack, said planar abutment being oriented generally transverse to the planes of the aligned sheets comprising the stack, the apparatus additionally having a stack lifter which can be moved between a position where it is at least in part located below the lowermost sheet in the stack to provide support therefor and a retracted position, the improvement comprising:

a stop member, said stop member being movable between a first position where it is coplanar with the magazine front stop and a second position where it is out of registration with the magazine front stop, said stop member in said first position contacting the front edges of at least some of the sheets in the stack whereby a force which acts in the plane thereof is applied to each of the contacted sheets; and means for imparting movement to said stop member to cause said stop member in said first position to act upon the front edge of at least a sheet in the stack which abuts said deflected sheet to maintain the alignment of said abutting sheet during the pulling of said deflected sheet from the stack, said stop member being withdrawn from said abutting sheet to said second position by said movement imparting means during the subsequent deflection of said abutting sheet to thereby eliminate said stop member applied force whereby the force required to cause sheet deflection is reduced.

2. The apparatus of claim 1 further comprising:

a recess in the magazine front stop, said stop member being positioned in said recess when acting upon a sheet in the stack.

3. The apparatus of claim 2 wherein the stack receiving magazine has a bottom, the magazine bottom defining an opening through which sheets acquired by said gripper mechanism are withdrawn, the front edge of a sheet extending through said opening subsequent to deflection thereof, and wherein said recess extends upwardly from the bottom of the magazine front stop.

4. The apparatus of claim 1 wherein the stack receiving magazine has a bottom, the magazine bottom defining an opening through which sheets acquired by said gripper mechanism are withdrawn, the front edge of a sheet extending through said opening subsequent to deflection thereof.

5. The apparatus of claim 1 wherein said stop member is integral with the stack lifter.

6. The apparatus of claim 5 wherein the stack lifter with said integral stop member is pivotally mounted whereby said stop member may be swung into and out of alignment with said planar abutment defined by said magazine front stop.

7. The apparatus of claim 6 further comprising:

a recess in the magazine front stop, said stop member being positioned in said recess when acting upon a sheet in the stack.

8. The apparatus of claim 7 wherein the stack receiving magazine has a bottom, the magazine bottom defining an opening through which sheets acquired by said gripper mechanism are withdrawn, the front edge of a sheet extending through said opening subsequent to deflection thereof.

9. The apparatus of claim 8 wherein:

said recess extends upwardly from the magazine front stop.

10. A method for sequentially separating individual sheets from the bottom of a stack of planar sheets located in a magazine, the stack having lowermost sheet and each sheet having a front edge, the sheet front edges being generally in alignment in the stack, the magazine having a front stop which contacts the sheet front edges and defines a generally vertically oriented guide for preserving the alignment of the front edges of the sheets comprising the stack, the sheets in the stack being oriented generally transversely with respect to the front stop defined guide, said method comprising the steps of:

applying a downward force to said lowermost sheet in the stack in a region thereof adjacent the front edge of said lowermost sheet to cause the front edge of said lowermost sheet to be deflected downwardly with respect to the remainder of said lowermost sheet;

engaging the deflected front edge of said lowermost sheet and applying a pulling force thereto to slide the lowermost sheet from the bottom of the stack and the magazine;

positioning a movable stop at the level of and in contact with the sheet in the stack which abuts said lowermost sheet to defection thereof and prior to sliding said lowermost sheet from the magazine to thereby apply a force to said abutting sheet in the plane thereof to prevent friction between said lowermost sheet and said abutting sheet from causing displacement of the front edge of said abutting sheet relative to the stack thereby preserving the stack alignment; and retracting the movable stop after said lower most sheet has been pulled from the magazine to cause said abutting sheet to become a new lowermost sheet, said movable stop retraction eliminating said applied planar force whereby the force required to deflect the front edge of said new lowermost sheet is reduced.

11. The method of claim 10 further comprising:

positioning a support below said abutting sheet subsequent to deflection of the front edge of said lowermost sheet.

12. The method of claim 11 wherein said stop is moved with said support.

13. The method of claim 10 wherein the step of applying downward force comprises:

engaging said lowermost sheet by creating a pressure differential across a region of said sheet; and bending the engaged sheet downwardly.

14. The method of claim 13 wherein the step of bending is synchronized with the step of positioning the stop.

15. The method of claim 14 further comprising:

positioning a support below said abutting sheet subsequent to deflection of the front edge of said lowermost sheet.

16. The method of claim 15 wherein said stop is moved with said support.

* * * * *

UNITED STATES PATENT AND TRADEMARK OFFICE

CERTIFICATE OF CORRECTION

PATENT NO. : 5,535,998

DATED : July 16, 1996

INVENTOR(S) : Manfred Geffert and Joachim Schroder

It is certified that error appears in the above-indentified patent and that said Letters Patent is hereby corrected as shown below:

Column 5, last line, after "sheet" insert --subsequent--; and change "defection" to --deflection--.

Signed and Sealed this

Twenty-sixth Day of November 1996

*Attest:*

Bruce Lehman

BRUCE LEHMAN

*Attesting Officer*

*Commissioner of Patents and Trademarks*